US005268682A

United States Patent [19]

Yang et al.

[11] Patent Number: 5,268,682

[45] Date of Patent: Dec. 7, 1993

[54] RESOLUTION INDEPENDENT RASTER DISPLAY SYSTEM

[75] Inventors: Wen-Jann Yang, Amherst, N.Y.; Chih-Yuan Liu; Bor-Chuan Kuo, both of Hsinchu, Taiwan

[73] Assignee: Industrial Technology Research Institute, Taiwan

[21] Appl. No.: 772,710

[22] Filed: Oct. 7, 1991

[51] Int. Cl.[5] ..... G09G 5/36

[52] U.S. Cl. ..... 345/200

[58] Field of Search ..... 340/799

[56] References Cited

U.S. PATENT DOCUMENTS 4,562,435 12/1985 McDonough et al. .
4,684,942 8/1987 Nish et al. .
4,855,959 8/1989 Kobayashi .
4,884,069 11/1989 Farand ..... 340/799
5,001,672 3/1991 Ebbers et al. .
5,065,369 12/1991 Toda .
5,179,372 1/1993 West et al. .

OTHER PUBLICATIONS 262 144 By 4-Bit Multiport Video Ram, Texas Instruments, 1991, pp. 8-3 to 8-72 (TMS44C250).

*Primary Examiner*—Jeffery Brier
*Attorney, Agent, or Firm*—Meltzer, Lippe, Goldstein, Wolf, Schlissel & Sazer

[57] ABSTRACT

A raster video display system utilizes memory capacity more efficiently than conventional raster display systems and is independent of the specific resolution of the screen which is utilized in the system. The raster display system comprises a VRAM with split transfer capability and a unique address generator which can determine when pixels from a particular row of the screen display start on one row of the VRAM and extend over to the next row of the VRAM.

12 Claims, 14 Drawing Sheets

RESOLUTION INDEPENDENT RASTER DISPLAY SYSTEM

FIELD OF THE INVENTION

The present invention relates to a raster display system. The raster display system of the present invention makes efficient use of memory capacity and is resolution independent.

BACKGROUND OF THE INVENTION

The raster scan display is commonly utilized both in computer systems and in commercial televisions. An image displayed on the screen comprises an array of pixels arranged in rows and columns. The screen is usually refreshed sequentially row by row from top to bottom. Presently, the refresh rate is usually not lower than 30 Hz. A frame buffer stores the screen refresh data. When any datum in the frame buffer is updated, and the screen is refreshed, the corresponding pixel on the screen is changed.

FIG. 1 schematically illustrates a conventional raster display system. The display system 10 is utilized to display an image on the CRT screen 12. Data which is displayed on the screen 12 is stored in a frame buffer 14. In the conventional display system 10 of FIG. 1, the frame buffer 14 is a dynamic RAM (DRAM).

When the host computer 16 is ready to refresh the DRAM 14, an address is sent to the DRAM 14 from the host computer 16 via the address bus 15 and the multiplexer (MUX) 18. Data to be entered in the DRAM is sent from the host computer 16 to the random port 20 of the DRAM 14 via the bus 30.

To perform a screen refresh operation, an address is sent from the graphic controller 22 to the DRAM 14 via the bus 17 and the multiplexer 18. The data to be transmitted to the screen 12 in the screen refresh operation is read out of the DRAM 14 at the random port 20 and is transmitted via the bus 30 to the shift register 24 which serves as a parallel-to-serial converter. The data is converted from digital to analog form using the Digital-to-Analog converter (DAC) 26 and then transmitted to the screen 12. The timing of the shift register 24 is controlled by a video timing signal generated by the graphic controller 22 and transmitted to the shift register 24 via the line 19. The graphic controller 22 is connected to the host computer 16 via the bus 11 and also generates the vertical synchronization signal (VSYNC), the horizontal synchronization signal (HSYNC), the horizontal blank signal (HBLANK), the vertical blank signal (VBLANK), the horizontal display enable signal (HDE) and the vertical display enable signal (VDE) which are transmitted via lines 21–21*a* to the screen 12 and the DAC 26.

The display system 10 of FIG. 1 has a significant disadvantage. The major problem is that the bus 30 leading to and from the random port 20 is utilized to receive data from the host computer 16 for frame buffer refresh and to transmit data to the screen 12 for screen refresh. As is known, an increase in screen resolution will increase the time to do a screen refresh. When the time to do a screen refresh reaches a certain level, the host computer 16 will not be able to gain control over the bus 30 and random port 20 to perform frame buffer refresh operations. This conflict over use of the random port 20 and bus 30 results in a decrease in the efficiency of operation of the display system.

One way to avoid this kind of conflict is to implement the frame buffer as a video RAM (VRAM) instead of a simple DRAM. a VRAM 40 is illustrated in FIG. 2. The VRAM 40 of FIG. 2 comprises a DRAM array 42 with a random port 44. The VRAM 40 also has a serial port 45. The serial port 45 is illustratively formed by a shift register 46. An entire row of data from the DRAM 42 is transferred to the serial data register 46 via lines 47 by an operation which is called a read data transfer (RDT). The serial port 45 also includes a register select circuit 43 for implementing a tap pointer which counts synchronously with a serial clock 48. When a read data transfer operation is carried out, an initial value of the tap pointer is also specified. Then starting from the position in the serial data register 46 determined by the initial value of the tap pointer, data is serially transmitted out from the register 46 via the serial I/O 49.

FIG. 3 illustrates a video display system 10'. The system 10' of FIG. 3 is similar to the system 10 of FIG. 1. The differences are that the frame buffer is now implemented by the VRAM 40 instead of the DRAM 14 as in FIG. 1. In addition, the parallel-to-serial converter 24 is eliminated. In the system 10' of FIG. 3, a frame buffer refresh operation transfers data from the host computer 16 to the random port 44 of the VRAM 40 via the bus 47. On the other hand, to carry out a screen refresh operation, data is transferred from the serial port 45 in bit serial format to the DAC 26 for conversion to analog form for refreshing the display on the screen 12. In the display system 10', the serial clock for use by the serial port 45 of the VRAM 40 is supplied by the graphic controller 22 via the line 48.

In short, in the system 10' of FIG. 3, frame buffer refresh operations and screen refresh operations take place via different ports and utilize different buses, so that the two processes are isolated from each other. Therefore conflict between the two types of operations over access to the random port 20 and bus 30 of FIG. 1 are substantially resolved.

The problem with the system 10', of FIG. 3 is that the VRAM 40 utilized therein makes very inefficient use of memory capacity. This is illustrated through use of the following example. Consider the case where the screen 12 has a resolution of 1280 rows with 1600 pixels per row. The pixels in each screen row are labeled 0,1, . . . , 1599. The rows are labeled 0,1, . . . , 1279. The memory arrays 142 of a 256*4 VRAM for storing one 1280*1600 frame of pixels for a screen with this format are illustrated in FIG. 4A.

The memory capacity of FIG. 4A is divided into two banks, labeled BANK 0 and BANK 1. Each bank comprises eight memory arrays. The memory arrays of BANK 0 are labeled 1,2,3,4,5,6,7,8. Similarly, the memory arrays of BANK 1 are labeled 1,2,3,4,5,6,7,8. Each memory array is $2^9 \times 2^9$ which means that it has 512 rows and 512 columns locations per row. The 512 rows of each memory array are labeled 0,1, . . . in FIG. 4A. The 512 columns of each memory array are labeled 0,1, . . . , 199, . . . , 256, . . . , in FIG. 4A. The pixels 0,1,2,3 . . . , 1599 of the row 0 of one frame for the screen 12 ar stored in the memory of FIG. 3 as follows. Pixels, 0,8, . . . , 1592 of row 0 of the display screen frame occupy column locations 0,1, . . . , 199 of row 0 of the first memory array in BANK 0. Pixels 1,9, . . . , 1593 of row 0 of the display screen frame occupy column locations 0,1, . . . , 199 of row 0 of the second memory array in BANK 0. Pixels 2,10, . . . 1594 of row 0 of the display screen frame occupy column locations 0,1, . . . , 199 of row 0 of the third memory array of BANK 0. Pixels 7,15, . . . , 1599 of row 0 of the display screen frame occupy column locations 0,1, . . . , 199 of row 0 of the eighth memory array of BANK 0.

In a similar manner, pixels 0,8, . . . , 1592 of row 1 of the display screen frame occupy column locations 256,257, . . . 455 of row 0 of memory array 1 of BANK 0. Pixels 1,9, . . . , 1593 of row 1 of the display screen frame occupy column locations 256, 257, . . . , 455 of row 0 of memory array 2 of BANK 0. Pixels 7,15, . . . , 1599 of row 1 of the frame occupy pixel locations 256, 257 . . . 455 of row 0 of the memory array 8 of BANK 0.

In a similar manner, pixels 0,8, . . . , 1592 of row 2 of the display screen frame occupy column locations 0,1, . . . ,1 99 of row 1 of memory array 1 of BANK 0. Pixels 0,8, . . . , 1592 of row 3 of the screen display occupy column locations 256,257, . . . 455 of row 1 of memory array 1 of BANK 0.

FIG. 4B illustrates in general where particular screen rows are stored in the memory BANKS 0 and 1. The BANK 0 stores pixels for the screen rows 0,1, . . . , 1023 and the BANK 1 stores pixels for the screen rows 1024, . . . , 1279. Each VRAM row stores pixels belonging to two screen rows, the pixels from the even numbered screen rows are stored in the left-hand half of the VRAM memory array and the pixels from the odd numbered screen rows are stored in the right-hand half of the VRAM memory array.

Data is transmitted to the screen 12 of FIG. 3 from the memory of FIGS. 4A and 4B as follows. To display the screen row 0, during a vertical blanking interval, the row 0 of each memory plane in BANK 0 is transferred to the serial port in a read data transfer operation with an initial tap value zero. The data in the serial port is then transferred in bit serial format to the screen. During the horizontal blanking interval following the display of the screen row 0, the row 0 of each memory plane in BANK 0 is again transferred to the serial port, this time with a tap value of 256. The data stored at positions 256, 257, . . . in the serial port is then transferred serially to the screen to refresh row 1 of the screen display. Then row 2 and then row 3 of the screen display are refreshed in the same manner. The process continues until the last row in the screen is refreshed.

As seen from the example of FIG. 4A and FIG. 4B, the VRAM wastes a significant amount of memory space. For a screen resolution comprising 1280 rows*1600 columns, 112 spaces in each VRAM row are empty. On the other hand a different screen resolution may not be able to make use of the memory architecture at all. For example, if a screen row requires more than 256 spaces, the memory apparatus of FIGS. 4A and 4B cannot be utilized.

In view of the foregoing, it is an object of the present invention to provide a display system which makes more efficient use of memory resources.

It is also an object of the invention to provide a display system whose structure is independent of a specific screen resolution.

SUMMARY OF THE INVENTION

The present invention is a video display system which makes efficient use of memory capacity and which is resolution independent, i.e., which operates with a wide variety of screen resolutions.

The inventive display system makes use of a special type of VRAM which performs an operation known as a split transfer. In a split transfer operation, one-half of a VRAM row can be transmitted to the serial data register which forms the serial port without interfering with the other half of the VRAM row. The serial data register of this type of VRAM can be viewed as comprising two half rows, each with its own tap pointer. In a split transfer operation when the tap pointer of one of the half rows reaches the end of its half row, data will then be read out from the other half row starting from the location of the tap pointer in the other half row.

When this type of VRAM is utilized, it is now possible for pixels from one row of the screen display to be divided over two rows of a VRAM. For example, pixels from a row on the screen may start in the second half near the end of one row of VRAM and continue in the first half of the next row of VRAM. This enables the display system of the present invention to make more efficient use of memory capacity and enables a given VRAM to be utilized in a display system independent of the resolution of the screen.

In the inventive display system, frame buffer refresh operations takes place through a random port of the VRAM. Screen refresh operations take place through the serial port with split transfer capability.

The inventive display system comprises a unique address generator. The address generator determines for each row of the screen, whether the corresponding pixels are in one row of the VRAM or divided over two rows of the VRAM. When the pixels of a specific screen row are in one row of a VRAM, an ordinary read data transfer takes place in the horizontal blanking interval preceding the display of the specific screen row with the tap pointer set to the appropriate starting location in the serial data register of the serial port. When the pixels of a specific screen row are divided such that they start in the second half one row of VRAM and continue in the first half of the next row of VRAM, the address generator of the present invention operates as follows. During the horizontal blanking interval immediately preceding the display of the specific screen row, a read data transfer is performed wherein the line of VRAM that includes the first part of the specific screen row is moved to the serial data register of the serial port. A first tap pointer associated with the full line read data transfer operation is set to the appropriate position in the serial data register where the screen row begins and the bits are read out to the screen. During the horizontal display interval, while the first part of the screen row is being refreshed, a split transfer is performed wherein the first half of the next row of VRAM is moved into the first half of the serial data register and a second tap pointer associated with the first half of the serial data register is set to zero. When the first tap pointer reaches the end of the serial data register, the tap pointer associated with the first half of the serial data register starts to read out bits from the next line of the VRAM. In this manner, a line from a screen display may be stored over more than one line of VRAM.

In short, a unique raster display system in which pixels from a single screen row may be divided over two rows in a frame buffer comprises a VRAM with a split register data transfer capability in combination with a unique address generator. The address generator detects when pixels from a particular screen row are divided over two VRAM rows and initiates a split transfer operation to read out the particular screen row from the VRAM.

DETAILED DESCRIPTION OF THE INVENTION

Figure 1:
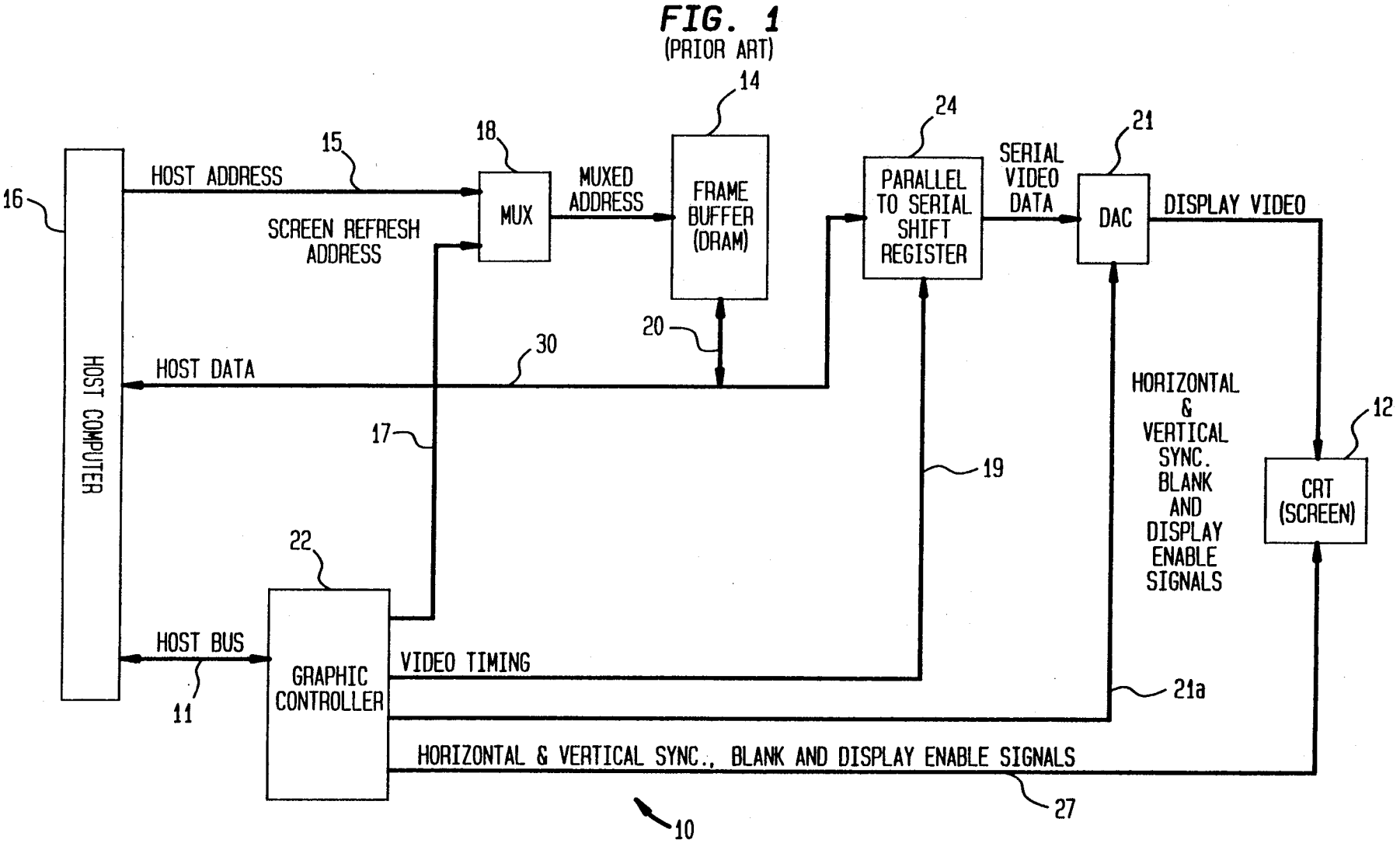
FIG. 1 (PRIOR ART)
FIG. 1 schematically illustrates a conventional raster display system in which the frame buffer is implemented using DRAM.
Figure 2:
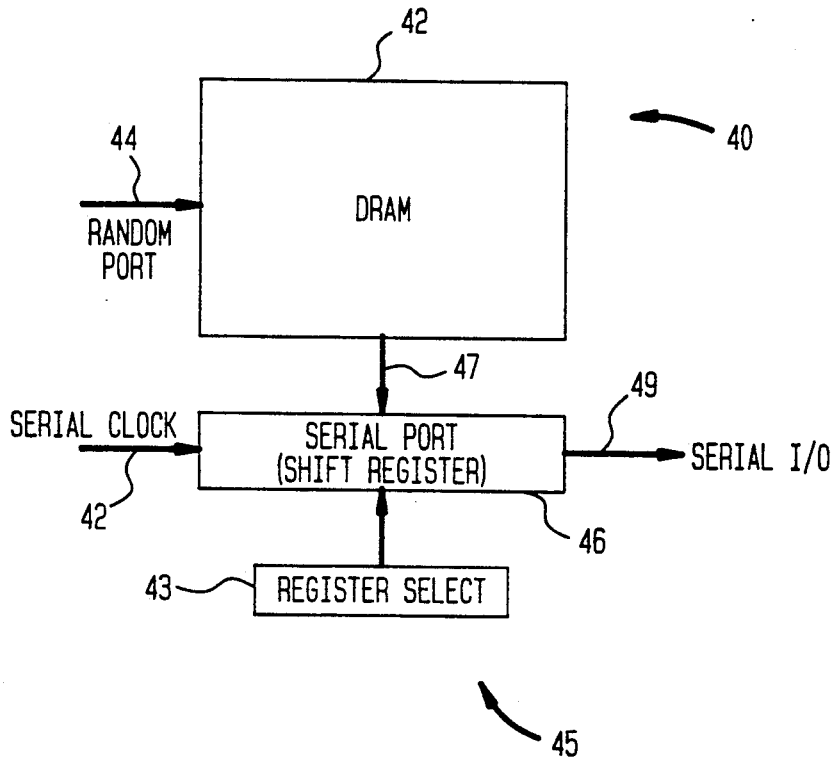
FIG. 2 (PRIOR ART)
FIG. 2 schematically illustrates a VRAM with a serial port.
Figure 3:
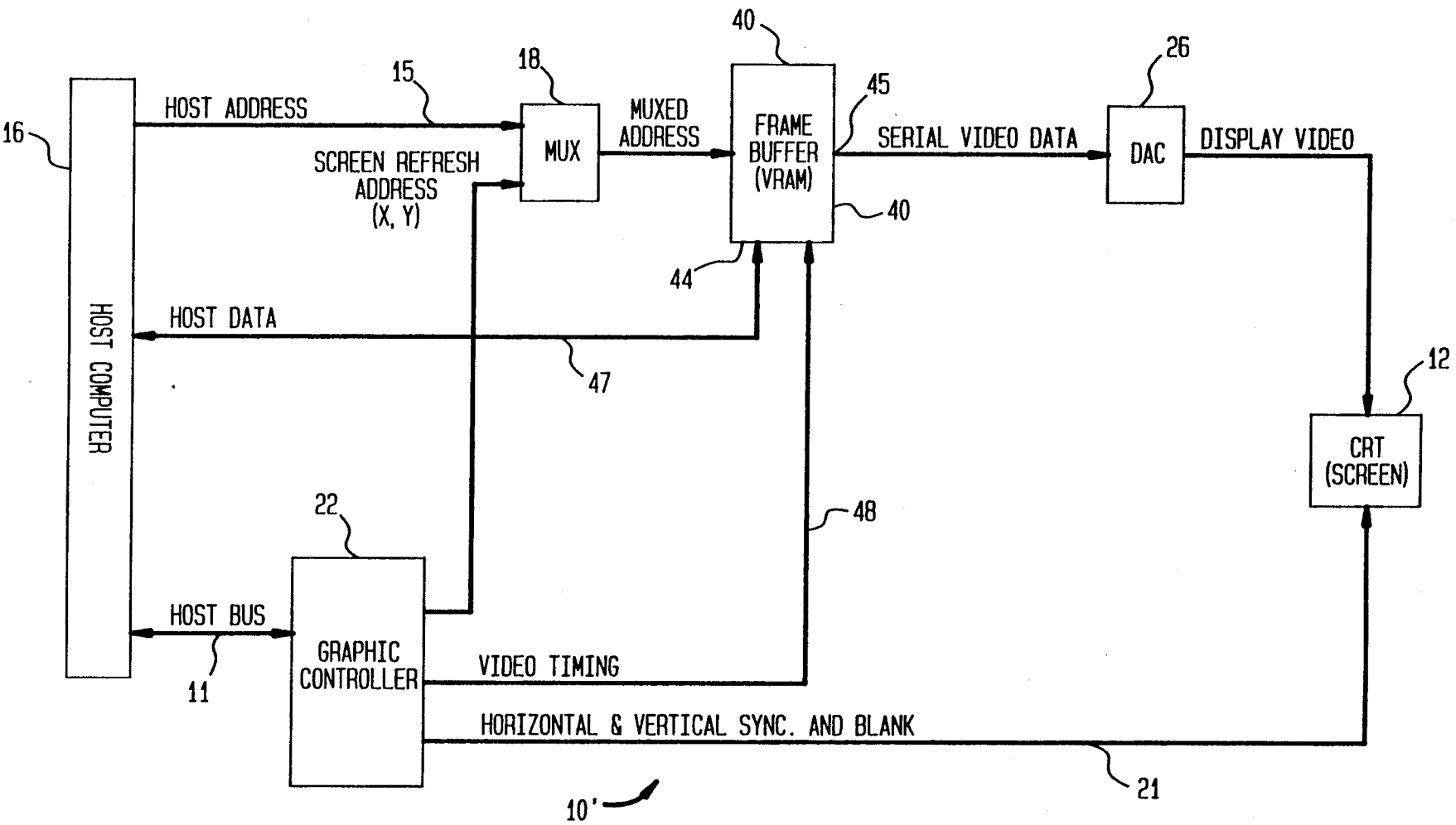
FIG. 3 (PRIOR ART)
FIG. 3 schematically illustrates a conventional raster display system in which the frame buffer is implemented using the VRAM of FIG. 2.
Figure 5:
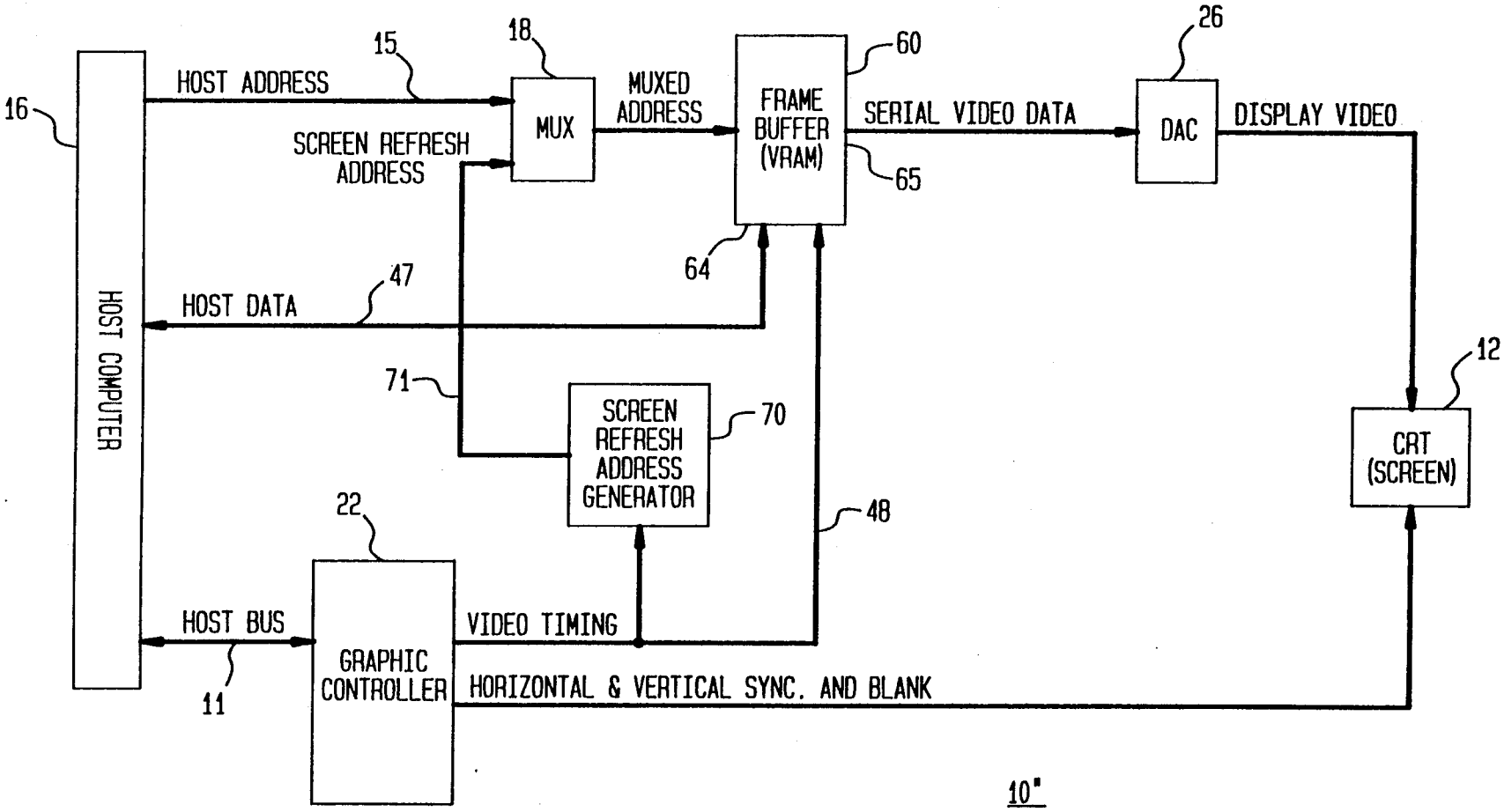
FIG. 5 schematically illustrates a raster display system in accordance with an illustrative embodiment of the present invention.

FIG. 5 schematically illustrates a raster display system 10″ in accordance with an illustrative embodiment of the invention. The system 10″ of FIG. 5 differs from the system 10′ of FIG. 3 in that the frame buffer of the system 10″, is implemented using a VRAM 60 with split transfer capability rather than by using the VRAM of FIG. 3 which has no split transfer capability. In addition, the system 10″ of FIG. 5 comprises the screen refresh address generator circuit 70. In the system 10″ of FIG. 5 addresses for screen refresh operations are generated by the address generator circuit 70 and transmitted via the bus 71 to the multiplexer 18. In contrast, in the system 10′ of FIG. 3, addresses for screen refresh operations are generated by the graphic controller 22. In the system 10″ of FIG. 5, buffer refresh operations write data into the VRAM 60 via the random port 64. Screen refresh operations read data out of the serial port 65.

As indicated above, the use of the VRAM 60 with split transfer capability and the use of the address generator 70 enables the display system 10″ of FIG. 5 to make very efficient use of the memory capacity of the VRAM 60 and enables the system 10″ to be independent of the resolution of the specific screen 12 utilized in the system.

Figure 6:
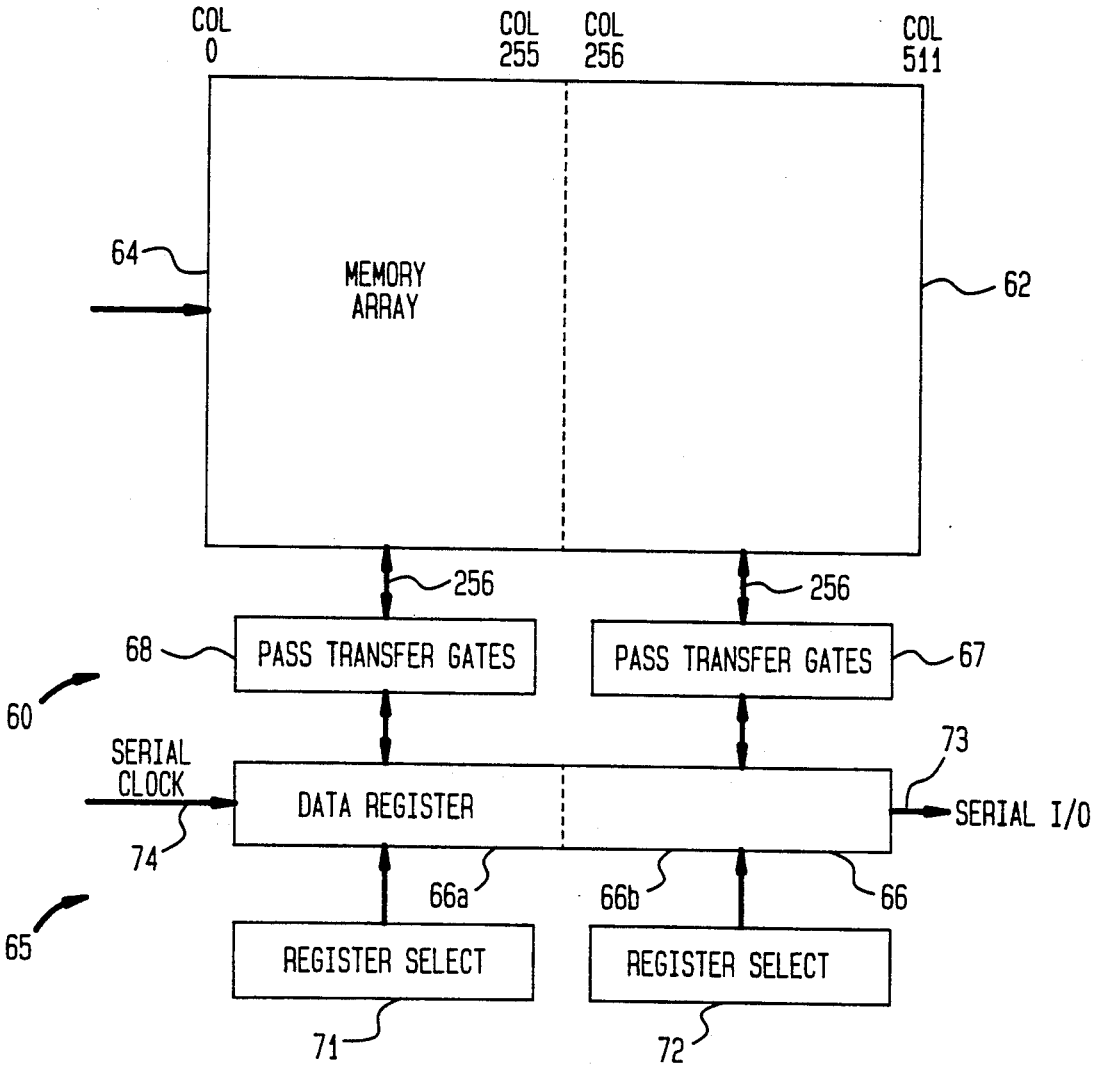
FIG. 6 schematically illustrates a VRAM with split transfer capability.

A VRAM 60 with split transfer capability is illustrated in FIG. 6. The VRAM 60 comprises a memory array 62 which illustratively comprises 512 rows × 512 columns. The columns are labeled near the top of FIG. 6. The VRAM 60 includes a random port 64 through which pixels may be written into the memory array 62. The VRAM 60 also has a serial port 65 with split transfer capability. Thus the serial port 65 can perform conventional read data transfer (RDT) operations and split transfer operations. In a read data transfer, the data register 66 acts as single shift register unit. The gate units 67 and 68 are simultaneously enabled so that an entire row of 512 pixels is transferred to the shift register 66. A single tap pointer is implemented by one of the register select circuits 71 and 72. Pixels are transmitted serially via the serial I/0 73 starting at the position in the register 66 indicated by the single tap pointer synchronously with the serial clock 74.

In split transfer operation, the serial data register 66 is split into two halves 66*a*, 66*b*. The first half 66*a* contains bit positions 0 through 255 and the second half 66*b* contains bit positions 256 to 511. In the case of a split transfer only one of the gate units 67 or 68 is enabled so that only the first half or the second half of a VRAM row is transferred to the first half or the second half of the data register 66. A split transfer operation makes use of first and second tap pointers implemented by the register select circuits 71 and 72. The first tap pointer reads data out from the first half 66*a* of the data register 66 by counting synchronously with the serial clock and the second tap pointer reads data out of the second half of the data register 66 by counting synchronously with the serial clock 74. In the case of a split transfer, when the first or second tap pointer reaches position 255 or 511, respectively, the next bit is read out from the other half of the data register 66 starting from the position of the other tap pointer. It should be noted that in a split transfer operation, data may be transferred into one half of the data register, while data is being read out of the other half. An example of a VRAM with split transfer capability is the TMS44C251 available from Texas Instruments.

Figure 7:
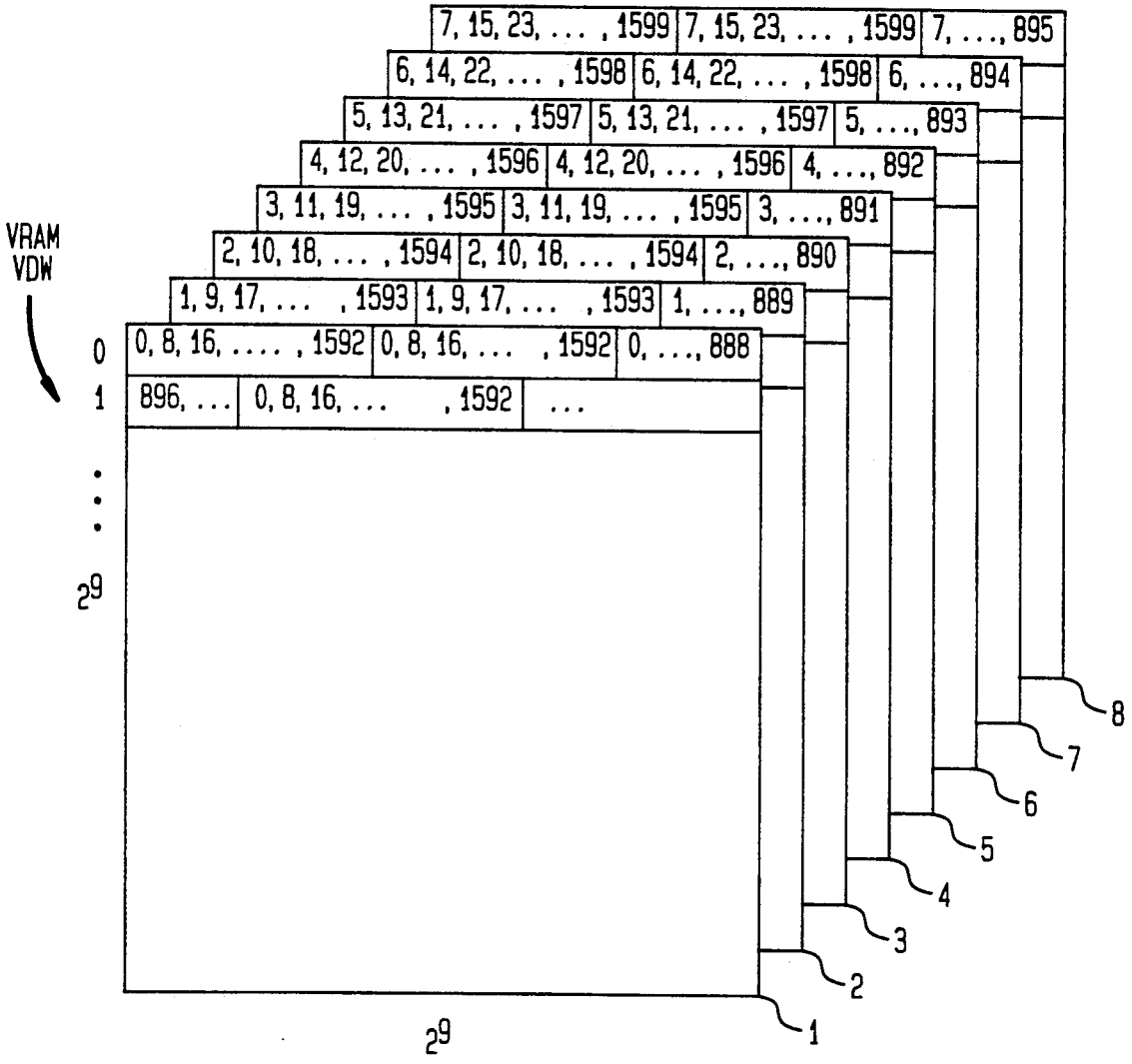
FIG. 7 illustrates the organization of data in VRAM of FIG. 6.

FIG. 7 illustrates how a frame comprising 1280 rows 0,1, . . . , 1279, with each row comprising 1600 pixels, 0,1, . . . , 1599 may be stored in the memory arrays of a VRAM of the type illustrated in FIG. 6. FIG. 7 illustrates eight VRAM arrays labeled 1,2,3, . . . , 8. Each VRAM array is 512×512.

The pixels 0,8,16, . . . , 1592 from row 0 of the frame occupy the column locations 0,1, . . . , 199 in row 0 of the memory array 1. The pixels 1,9,17, . . . , 1953 from row 0 of the frame occupy the column locations 0,1, . . . , 199 in row 0 of the memory array 2. The pixels 7,15,23, . . . , 1599 from row 0 of the frame occupy the column locations 0,1, . . . , 199 of row 0 of the memory array 8. The pixels 0,8,16, . . . , 1592 of row 1 of the frame occupy the column locations 200,201, . . . , 399 of row 0 in the memory array 1. The pixels 1,9, . . . , 1593 of row 1 of the frame occupy the column locations 200,201, . . . , 399 of row 0 in the memory array 2. The pixels 7,15, . . . , 1599 of row 1 of the frame occupy column locations 200, . . . , 399 of row 0 of the memory array 8.

Figure 4A:
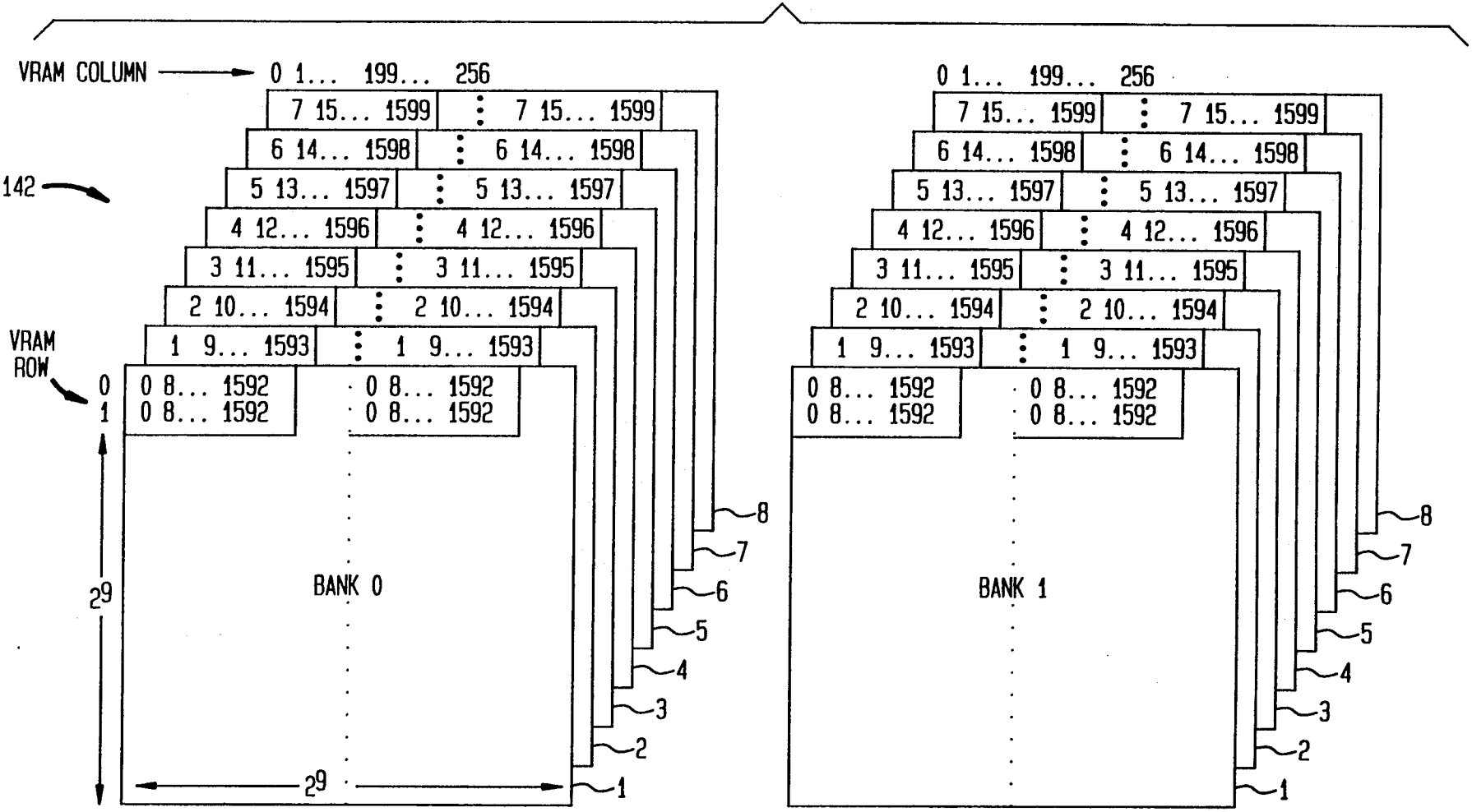
FIG. 4A (PRIOR ART)
FIG. 4A and FIG. 4B illustrate the organization of data within the VRAM of FIG. 2.
Figure 4B:
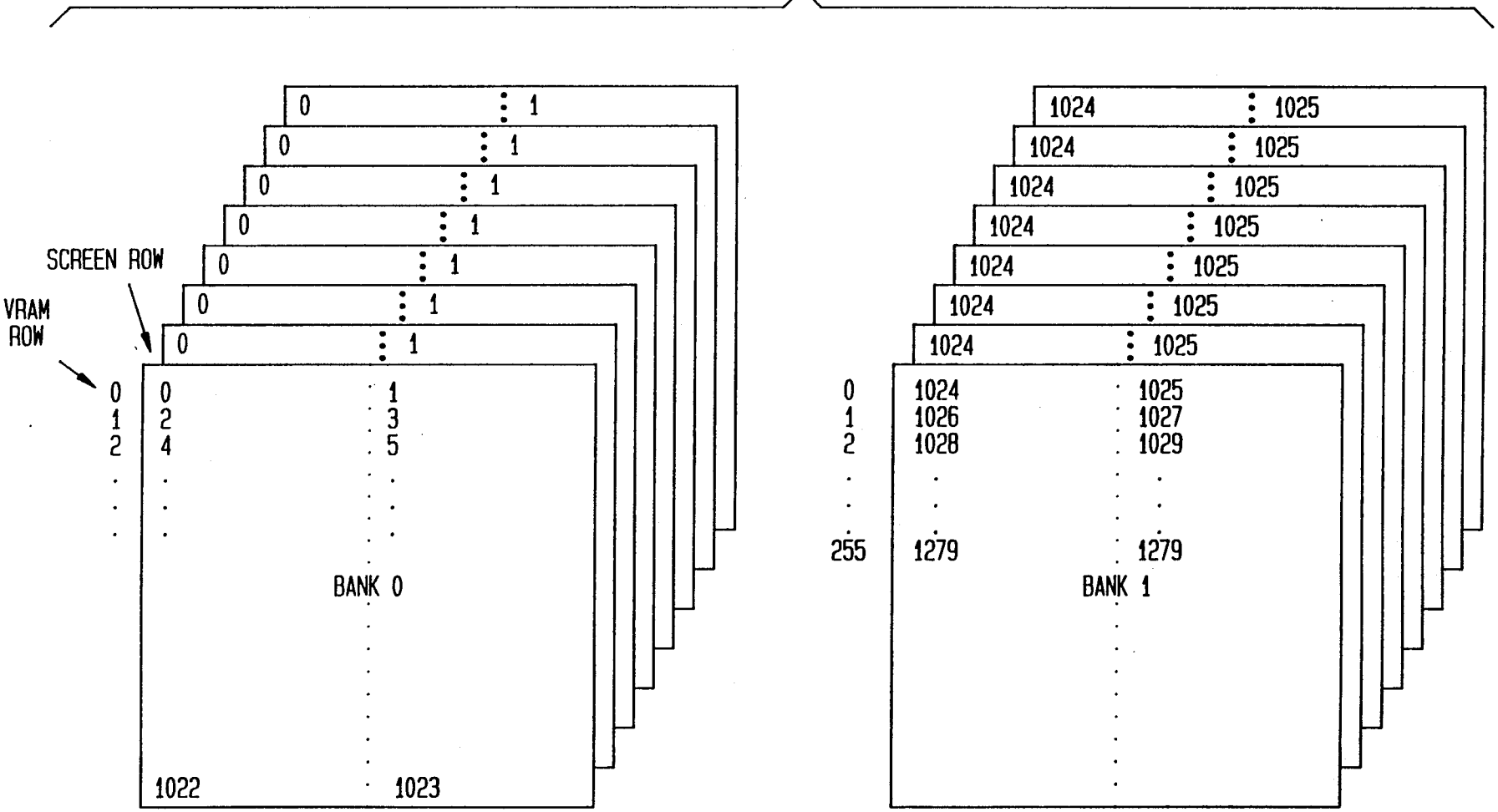
FIG. 4B (PRIOR ART)

The pixels from row 2 of the screen are split between two rows of each memory array. For example, the pixels 0,8,...,888 of row 2 of the frame occupy the column locations 400 through 511 of the row 0 of the memory array 1, while the pixels 896, . . . , 1592 of row 2 of the frame occupy the column locations 0 through 87 in row 1 of the memory array 1. The pixels 0,8,16, . . . , 1592, of the frame row 3 then occupy positions 88 . . . 287 in row 1 of the memory array 1. Note that in contrast to FIGS. 4A and 4B a frame of resolution 1600×1280 requires only one bank of eight memory arrays rather than two banks.

In the system 10" of FIG. 5, the screen 12 may be refreshed using non-interlaced or interlaced scanning. In the case of non-interlaced scanning, each frame of video comprises one field so that the screen 12 is scanned in the order: row 0, row 1, row 2, etc. In the case of interlaced scanning, a frame of video is composed of two fields. An odd field comprises the odd rows of a frame and an even field comprises the even rows of a frame. In the case of interlaced scanning, the even rows of the screen, i.e., rows 0,2,4 . . . are scanned first and then the odd rows, i.e. rows 1,3,5, are scanned.

The operation of the raster display system 10,, of FIG. 5 differs depending on whether non-interlaced or interlaced scanning is utilized. Consider first the case of non-interlaced scanning. During the vertical blanking interval, the pixels from row 0 of the VRAM of FIG. 7 are moved to the serial data register of the serial port through use of a read data transfer operation, with the tap pointer set to zero. The pixels for row 0 on the screen are serially read out of the serial data register as the tap pointer advances from position 0 to position 199. During the horizontal blanking period following the refreshing of the screen row 0, a read data transfer operation is again performed, to transfer to the serial data register the VRAM row 0, this time with the tap pointer set initially to the position 200. The pixels for row 1 on the screen are serially read out of the serial data register as the tap pointer counts from position 200 to position 399. During the next horizontal blanking interval, a read data transfer operation is again performed to transfer to the serial data register the VRAM row 0, this time with the tap pointer initially set to the position 400. The pixels for the first part of row 2 on the screen are serially read out of the serial data register as the tap pointer counts from position 400 to position 511. However, the pixels from the screen row 2 are partly stored in row 0 of the VRAM and partly stored in row 1 of the VRAM. Thus during the horizontal display interval, while the pixels comprising the first part of the screen row 2 are being read out of the serial data register, a split transfer operation takes place. In this split transfer operation, the first half of the VRAM row 1 is transferred to the first half of the serial data register in the serial port with a tap pointer set to position 0. When the tap pointer associated with the second half of the serial data register reaches position 511, the tap pointer associated with the first half of the serial data register starts reading data from the position 0 to complete refreshing the row 2 of the screen. With this process, every row on the screen is sequentially refreshed. When the last screen row is refreshed, there follows a vertical blanking interval. After the vertical blanking interval, the screen refresh process starts again with the screen row 0. In this manner frames are sequentially displayed on the screen.

In brief, the screen refresh process starts from the vertical blanking interval where a read data transfer operation for the screen row 0 takes place. A read data transfer operation is performed during each horizontal blanking interval. When a screen row comprises pixels which are split between the second half of one VRAM row and the first half of the next VRAM row, a split transfer operation is required. The timing of the read data transfer (RDT) and split transfer (ST) operations is illustrated in FIG. 8.

Figure 8:
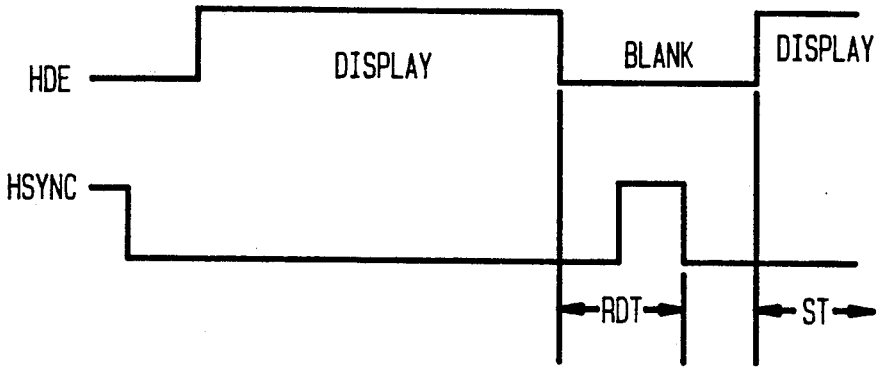
FIG. 8 illustrates the timing of split transfer and read data transfer operations in the VRAM of FIG. 6.
Figure 9:
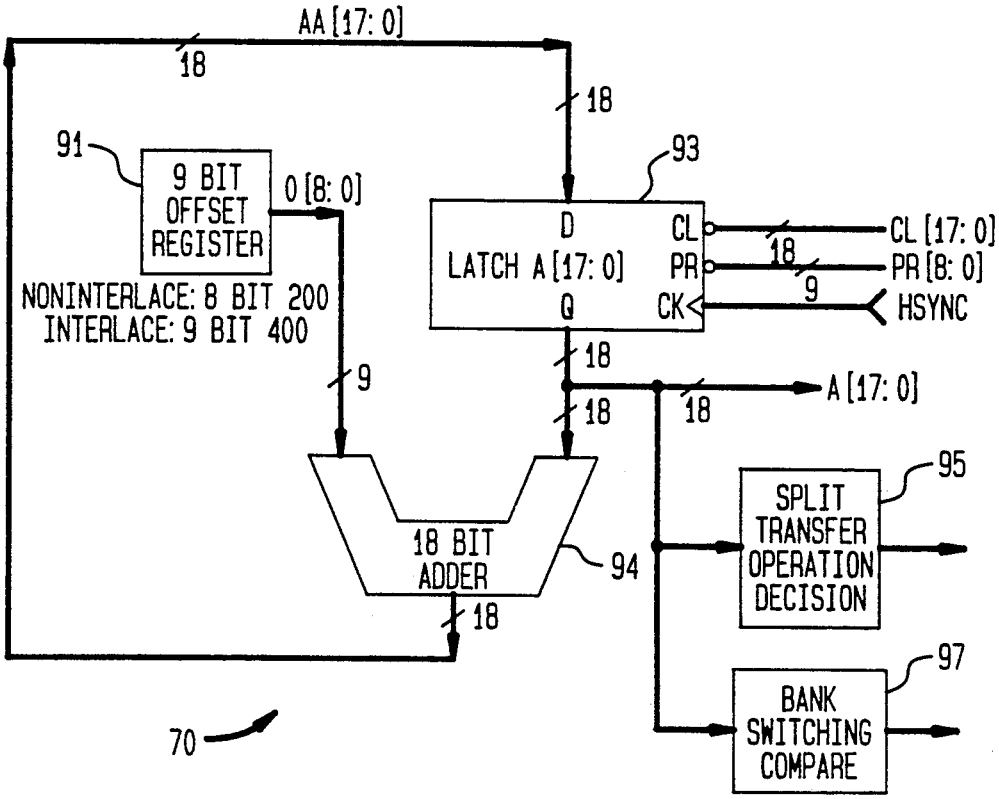
FIG. 9 schematically illustrates an address generator circuit for use in the raster display system of FIG. 5.

FIG. 8 illustrates the horizontal display enable (HDE) signal including the horizontal display interval and the horizontal blanking interval. FIG. 9 also illustrates the HSYNC signal. As shown in FIG. 9, a read data transfer (RDT) operation starts at the beginning of the horizontal blanking interval and is completed before the end of the HSYNC pulse. The split transfer (ST) operation takes place at the start of the horizontal display interval.

The initial tap pointer addresses utilized in the read data transfer and split transfer operations are generated by the address generator circuit 70 of FIG. 5.

The address generator circuit 70 is illustrated in greater detail in FIG. 9. The address generator circuit 70 comprises an offset register 91, a latch A which is labeled with the identifying numeral 93, and an eighteen bit adder 94. The address generator circuit 70 also comprises a split transfer operation decision circuit 95 for deciding when a split transfer operation is required and an optional bank switching compare circuit 97.

The latch A is an eighteen bit latch. The output signal of the latch A is the eighteen bit signal A[17:0]. The meaning of this signal can be summarized by the following equations.

For a Read Data Transfer Operation:

$$\text{row address } [8:0]=A[17:9] \text{ column address } [8:0]=A[8:0] \quad (1)$$

For a Split Transfer Operation:

$$\text{row address } [8:0]=A[17:9] \text{ column address } [8:0]=0 \quad (2)$$

This means that in a read transfer operation, a nine bit row address is contained in the bits 9,10, . . . , 17 of the signal A, and an initial column address (i.e., initial position of the tap pointer) is contained in bits 0,1, . . . 8 of the signal A. For a split transfer operation, a nine bit row address is given by the bits 9,10, . . . , 17 of the signal A and the column address is always 0.

The latch A receives at its clock input CK the HSYNC signal. The latch A also receives a signal CL[17:0] at the CL input and a signal PR[8:0] at the PR input.

Because a row on the screen occupies 200 spaces in a row of the VRAM, the value of the nine-bit offset register are represented by the signal O[8:0] is 200.

In the case of non-interlaced scanning, the address generator circuit 70 operates as follows. During a vertical blanking period, latch A's value (i.e. The signal A [17:0]) is set to 0. Afterwards, the value of latch A increases by the value 200 at each HSYNC pulse. This is accomplished by utilizing the eighteen-bit adder 94 to add the signal A[17:0] at the Q output of the latch A to the O[8:0] signal produced by the offset register 91 to generate the signal AA[17:0]. The signal AA[17:0] is then returned to the D input of the latch A. For each value of A[17:0], there is a read data transfer or split transfer operation in accordance with equations (1) or (2).

Figure 10:
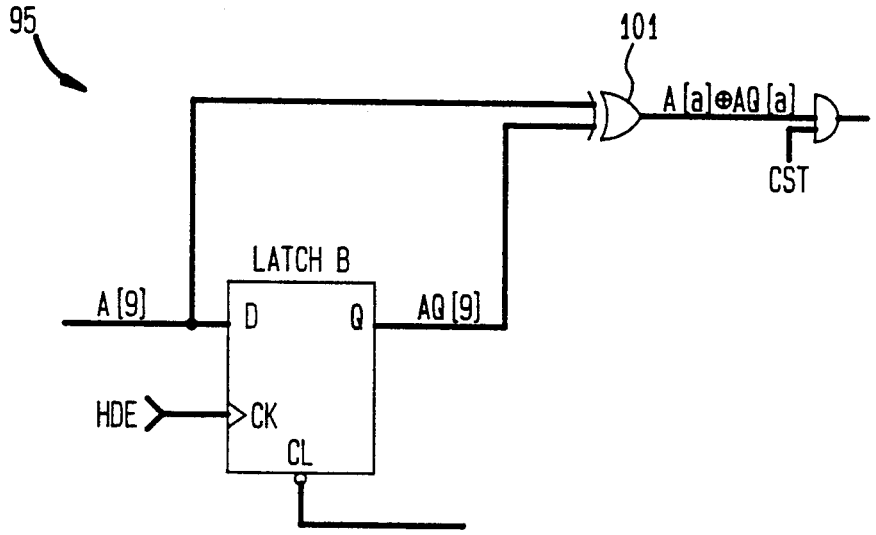
FIG 10 illustrates a split transfer decision circuit for use in the address generator circuit of FIG. 9.

The circuit 95 indicates the necessity of a split transfer operation by determining if the pixels of a particular screen row are divided over two VRAM rows. The circuit 95 is illustrated in greater detail in FIG. 10. The circuit 95 comprises the latch B which is a one-bit latch. The clock input CK of the latch B receives the horizontal display enable (HDE) signal. At the D input, the latch B receives the one-bit signal A[9] which is the ninth bit position of the signal A[17:0] of FIG. 10. The Q output of the latch B is the signal AQ[9]. According to FIG. 8, FIG. 9, and FIG. 10, latch B in FIG. 10 uses the falling edge of horizontal display enable signal to latch A[9] so the AQ[9] represents the smallest number of a VRAM row corresponding to the present screen row. When time passes, AA[17:0] results from the value 0[8:0] being added to the value A[17:0] using 18 bit adder 94 in FIG. 9. And according to FIG. 8 and FIG. 9, latch A uses the falling edge of horizontal synchronization signal to latch AA[9] so that A[9] now represents the smallest number of a VRAM row corresponding to the next screen row. Because the bit 9 is the smallest number in a VRAM row, a condition of A[9].XOR-.AQ[9 ]=1 indicates that the present screen row is divided between two VRAM rows, thereby indicating a split transfer operation. In the circuit 95, an XOR gate 101 performs the operation A[9].XOR.AQ[9].

It is known that for certain screen resolutions, and for certain VRAM array dimensions the need for a split transfer operation cannot arise. An example of this is when the VRAM memory arrays have dimensions of 512*512 and the screen has a resolution of 1280*1024. A CST (Control Split Transfer) bit is provided for use in this situation. For example, a CST bit can be utilized to disable the AND gate 102 of FIG. 10 so that the output is 0 regardless of the actual result A[9].XOR.AQ[9] so that no split transfer operations are carried out.

Figure 11:
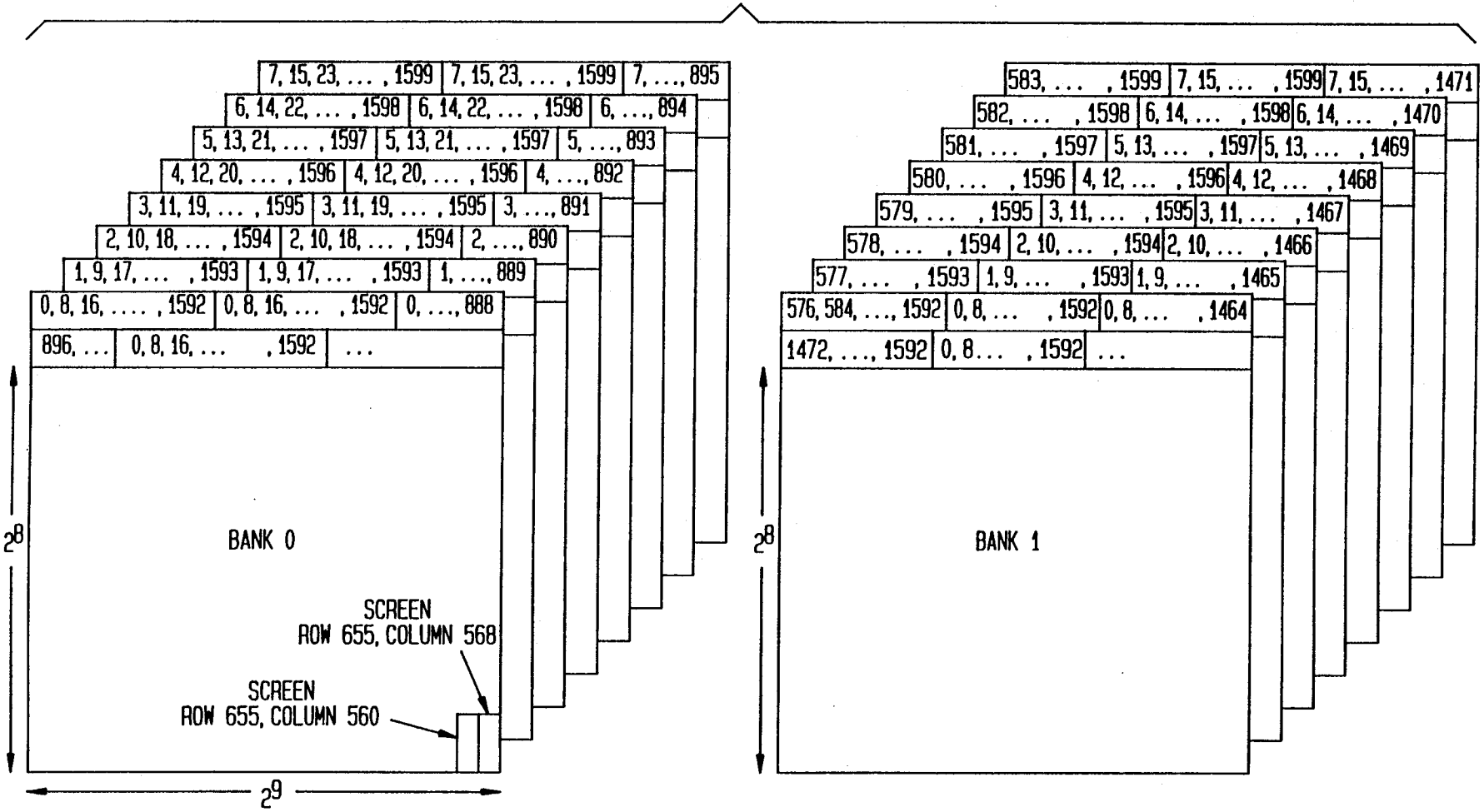
FIG. 11 illustrates data organization in a VRAM system comprising two banks.

Another situation to consider is where a screen row overstrides two different VRAM banks. This situation cannot occur when the screen resolution is below 2k*2k for a 256k*4 VRAM. However, consider the case where each VRAM memory array is size 512*256 and the screen resolution is 1600*1280. In this case, as shown in FIG. 11, because the individual memory arrays are relatively small, two memory bank (labeled BANK 0 and BANK 1) are needed to store all the pixels comprising one screen frame. Each of the memory banks comprises eight 512*256 memory arrays. The locations in the memory arrays of the pixels of the various screen rows are shown in FIG. 11. It should be noted the lower right-hand pixel location in the first memory array of BANK 0 stores the pixel 568 in the screen row 655. Thus, the situation here is that the pixels comprising the screen row 655 are divided between two memory banks.

To refresh the screen row 655, it is necessary to perform a bank transfer operation. This function is controlled by the optional bank switching compare circuit 97 which is part of the address generator 70 of FIG. 9. The circuit 97 is illustrated in greater detail in FIG. 12. The circuit 97 comprises the horizontal counter 110 which counts the number of pixel elements in a screen row. The register 112 stores the values 560 for example. The value 560 is chosen because it is the second from the last pixel position in the first memory array of the BANK 0 of FIG. 11. When the horizontal counter 110 reaches the value 560, a logic 1 signal is generated by the comparison unit 114. The output of the comparison circuit 114 is transmitted to the input 117 of the AND logic 116.

Figure 13:
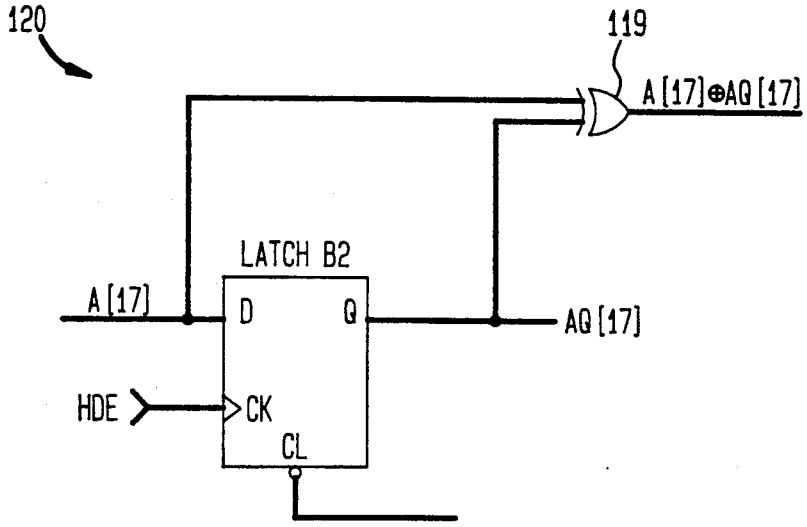

The input 118 of the AND logic 116 receives a signal A[17].XOR.AQ[17]. The signal A[17] is the signal in bit position 17 of the signal A of FIG. 9. The signal AQ[17] is generated through use of the circuit 120 of FIG. 13. The circuit 120 of FIG. 13 comprises the one-bit latch B2. The clock signal at the CK input of the latch B2 is the HDE signal. The D input of the latch B2 receives A[17] which is the $17^{th}$ bit position of the signal A[17:0] of FIG. 9. The Q output of the latch B2 outputs AQ[17]. AQ[17].XOR.A[17] is generated by the Exclusive OR gate 119.

Returning now to FIG. 12, the third input 121 of the AND logic 116 receives the compare enable bit CEB. In a situation where it is certain that no bank switching operating will be needed, CEB is set to zero which disables the circuit 97 of FIG. 12.

Figure 12:
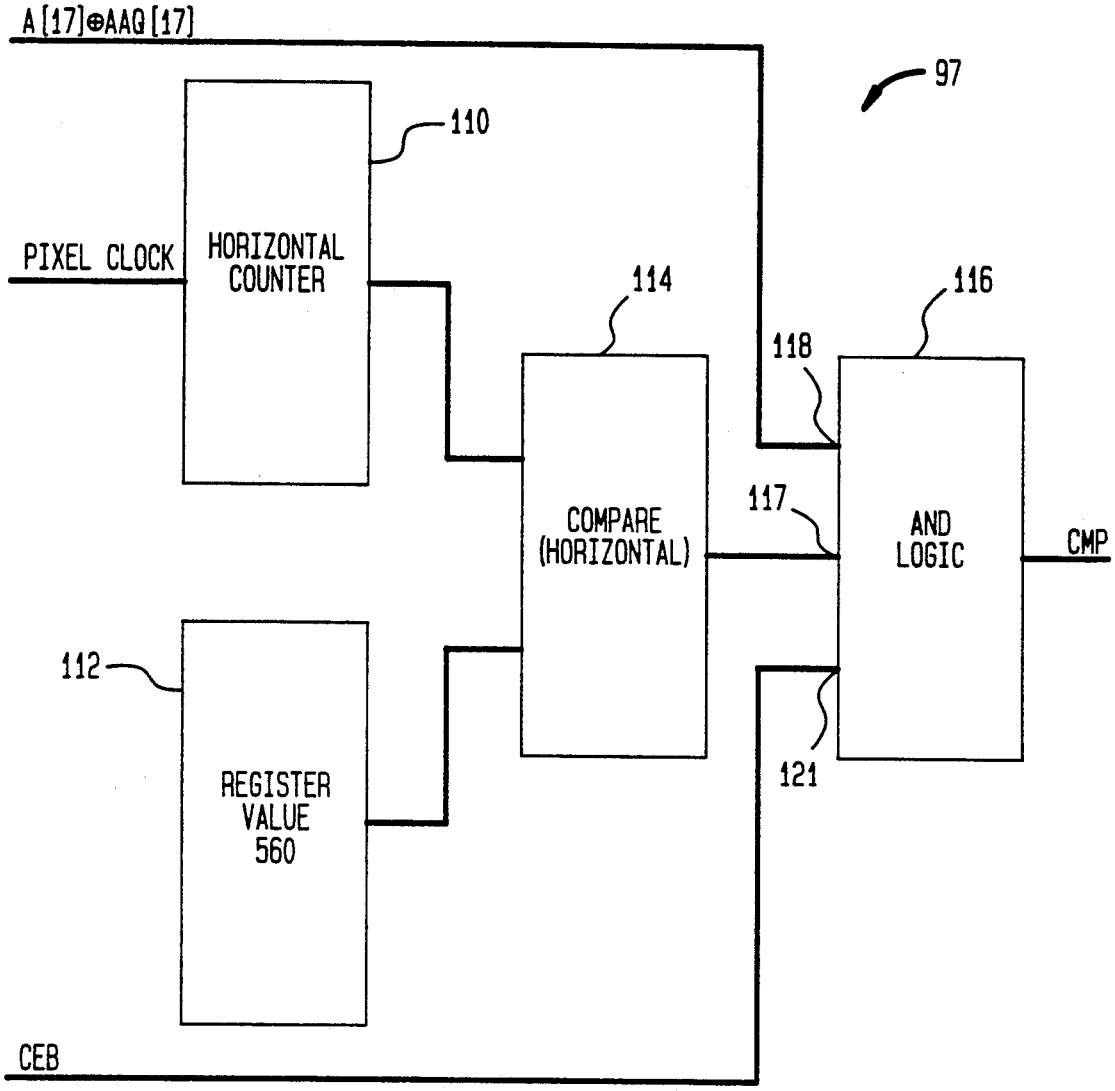
FIG. 12 and FIG. 13 schematically illustrate an optional bank switching compare circuit for use in the address generator circuit of FIG. 9.

The output of the AND logic 116 of FIG. 12 is the signal CMP. When CMP=1, control is transferred between the BANK 0 and the BANK 1 of FIG. 12. When control transfers to the BANK 1 a read data transfer operation takes place. This is in contrast to the situation when a screen row is split between two VRAM rows in which case a split transfer operation takes place.

Up to now, the case of non-interlaced scanning has been considered. As indicated above, it is also desirable to consider the case of interlaced scanning. In interlaced scanning, first there is scanned an even field comprising screen rows 0,2,4, . . . ; then there is scanned an odd field comprising screen rows 1,3,5, . . . To implement interlaced scanning, in the address generator 70 of FIG. 9, the offset register 91 is set to the value 400 rather than 200. Although scanning starts from row 0 for the even field and for row 1 in the odd field, the interval between scanned rows is the same for both fields. At the beginning of the odd field, latch A of FIG. 10 has a value 0. At the beginning of the odd field, latch A has a value 200. The setting of the latch A for the even and odd fields is accomplished through use of the preset (PR) and clear (CL) signals. In the case of interlaced scanning, the generator of row and column addresses and split transfer decisions is exactly the same as in the noninterlaced case.

Figure 14:
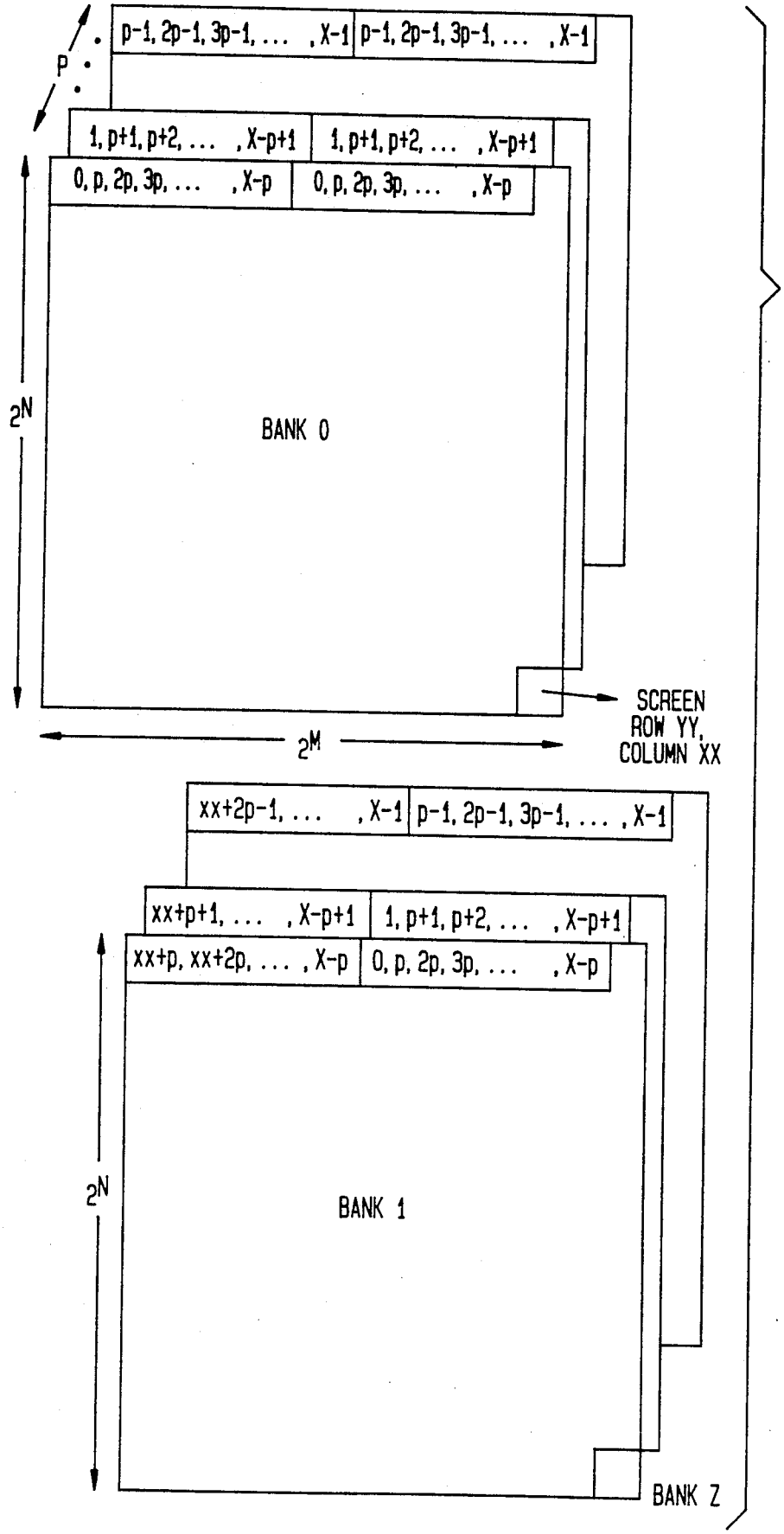
FIG. 14 illustrates the organization of pixels from an X*Y frame in a VRAM system comprising Z banks with pixels per bank, where each array has $2^{M}*2^{N}$ pixel locations.
Figure 15:
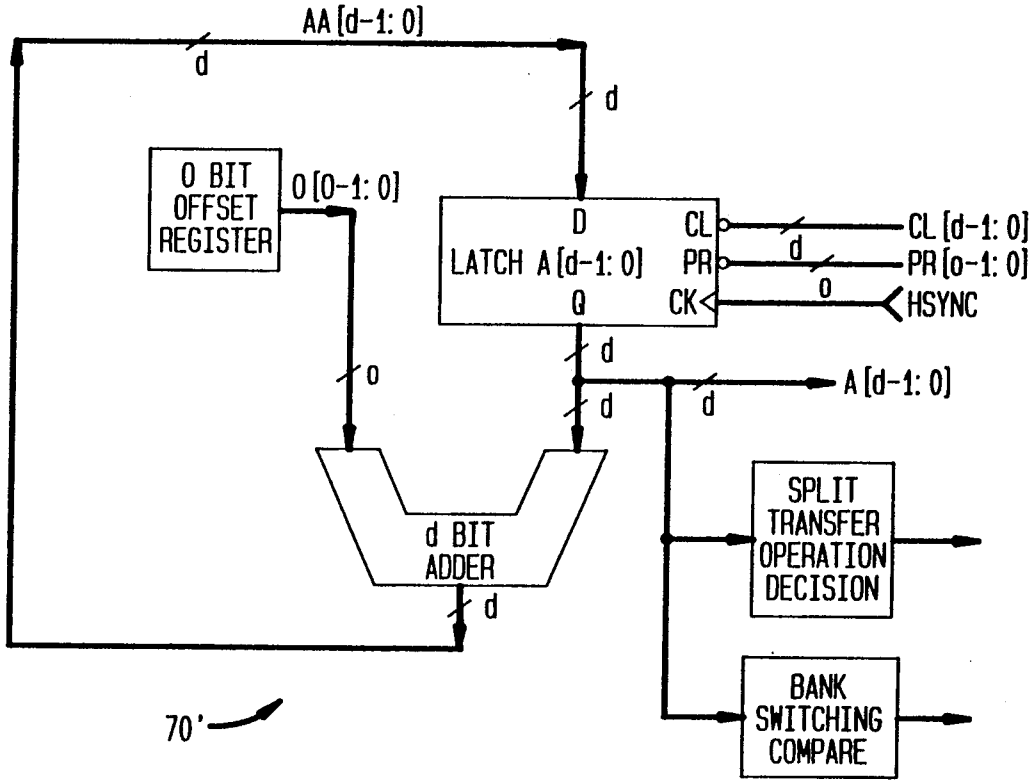
FIG. 15 illustrates an address generator circuit suitable for use with the VRAM system of FIG. 14.

Up to now, there has been discussed herein the case where the screen has a resolution of 1280*1600 and wherein the memory arrays in the VRAM system have a resolution of 512*512 or 512*256. It is now useful to consider the more general case. In the general case the screen has a resolution X*Y. The VRAM size is $2^M*2^N$. The number of VRAM memory arrays in a bank is p. The organization of pixels from one frame in such a VRAM structure is illustrated in FIG. 14. The number of bits in the latch A and the adder 94 in the address generator circuit 70 of FIG is d. The value of the offset register 91 is X/p in the case of a noninterlaced scan and 2X/p in the case of an interlaced scan. The number of bits O in the offset register 91 is determined by $2^{0-1} \geqq X/p$ for the case of a non-interlaced scan and $2^{0-1} \geqq 2X/p$ for the case of an interlaced scan, where in both cases 0 is the smallest integer which satisfies the inequality. The integer d is the smallest integer which satisfies $2^d = X*Y/p$. The number of banks, each of which includes p VRAM memory arrays is $(X*Y)/(p*2^M*2^N)$. An address generator circuit for this general case is illustrated in FIG. 15.

In short, a raster display system which makes efficient use of memory capacity and which is independent of screen resolution has been disclosed. Finally, the above-described embodiments of the invention are intended to be illustrative only. Numerous alternative embodiments may be devised by those skilled in the art without departing from the spirit and scope of the following claims.

We claim:

1. A raster display system comprising a raster display screen, a VRAM system in communication with said raster display screen comprising storage means comprising one or more memory arrays organized in rows and columns random port means for writing frame refresh pixels into said memory arrays, serial port means for reading pixels out of said memory arrays to refresh said screen, said serial port means having a capability of performing split transfer operations, in which only a portion of a memory row of data stored in said memory array is transferred to a corresponding portion of said serial port means, and read data transfer operations, in which an entire row of data stored in said memory array is transferred to said serial port means, said storage means storing pixels comprising one frame for display on said screen in a manner such that the pixels of certain rows of the frame are divided between two memory rows, and an address generator for controlling the reading out of pixels from said VRAM system for transmission to said screen, said address generator comprising decision means for determining if pixels from each row of said frame are contained in one of said memory rows or divided over two of said memory rows, and means for causing a split transfer operation to take place at said serial port means, when said decision means determines that a row of pixels from said frame is divided over two of said memory rows, for transferring only a portion of one of said memory rows of data of said memory array into a corresponding portion of said serial port means, while simultaneously causing said serial port means to output pixels from a second portion of said serial port means.

2. The raster display system of claim 1 wherein said raster display system comprises a host computer for writing frame refresh pixels into said storage means via said random port means.

3. The raster display system of claim 1 wherein when a specific row of pixels from said frame is divided over first and second of said memory rows, said address generator first causes a read data transfer operation to take place to transfer said first memory row to said serial port means and then causes a split transfer operation to take place to transfer a portion of said second memory row to said serial port means.

4. The raster display system of claim 3 wherein said read data transfer operation of said first memory row takes place during the horizontal blank interval immediately proceeding the transmission of the specific row of pixels to said screen.

5. The raster display system of claim 4 wherein said split transfer takes place during a horizontal display interval following said horizontal blanking interval.

6. The raster display system of claim 3 wherein when a specific row of pixels from said frame is in a single one of said memory rows, said address generator causes a read data transfer operation to transfer said single memory row to said serial port means during the horizontal blank interval immediately preceding the transmission of the specific row of pixels from said frame to said screen.

7. The raster display system of claim i wherein said address generator control the reading out of said pixels to generate a non-interlaced scan.

8. The raster display system of claim 1 wherein said address generator controls the reading out of said pixels to generate an interlaced scan.

9. The raster display system of claim 1 wherein said memory arrays are organized into a plurality of banks and said address generator comprises means for determining when to switch from reading pixels out of one bank to reading pixels out of another bank.

10. The raster display system of claim 1 wherein each row of said frame which is divided over two of said memory rows is divided such that a first part of the frame row is located in the second half of a first memory row and a second part of the frame row is located in the first half of a following memory row.

11. A method for refreshing a raster display screen comprising the steps of storing rows of pixels comprising a frame in a memory organized into rows and columns such that the pixels from some of the rows in said frame are divided over two memory rows, and reading said pixels out of said memory and transmitting them to said screen by determining if each row of pixels of said frame is located in one memory row or is divided over first and second memory rows, if a row of pixels of said frame is located in one memory row, reading said row of pixels of said frame out of said memory by performing a read data transfer operation, in which an entire memory row of data stored in said memory is transferred to a serial port, and if a row of pixels of said frame is divided over first and second memory rows, reading the part of the row of pixels of the frame in the first memory row using a read data transfer operation, and reading the part of the row of pixels of the frame in the second memory row using a split transfer operation in which only a portion of a memory row of data stored in said memory is transferred to a corresponding portion of said serial port.

12. A raster display system comprising a raster display screen for displaying a frame of pixels organized into rows and columns, a memory connected to said screen for storing a frame of pixels to be transmitted to said screen to refresh said screen, some of the rows of pixels comprising said frame stored in said memory being divided over two rows of said memory, and means for reading said frame pixels out of said memory including means for determining if each row of pixels in said stored frame is stored in one row of said memory or divided over two rows of said memory, and means for reading the rows of said frame stored in one row of the memory utilizing a read data transfer operation in which an entire memory row of data stored in said memory is transferred to said means for reading the rows of said frame, and for reading the rows of said frame divided over two rows of said memory utilizing a read data transfer operation followed by a split transfer operation in which only a portion of a memory row of data stored in said memory is transferred to a corresponding portion of said means for reading the rows of said frame.

* * * * *